US006234761B1

(12) United States Patent
Kocsis et al.

(10) Patent No.: US 6,234,761 B1
(45) Date of Patent: May 22, 2001

(54) APPARATUS FOR AN AIR LIFT AND TRANSFER PUMP

(75) Inventors: Ferenc Kocsis; Maxwell Bruce McKay, both of Waggrakine (AU)

(73) Assignee: Midwest Training Group (Inc.), Geraldton (AU)

( * ) Notice: Subject to any disclaimer, the term of this patent is extended or adjusted under 35 U.S.C. 154(b) by 0 days.

(21) Appl. No.: 09/242,943

(22) PCT Filed: Aug. 26, 1997

(86) PCT No.: PCT/AU97/00547

§ 371 Date: Jun. 14, 1999

§ 102(e) Date: Jun. 14, 1999

(87) PCT Pub. No.: WO98/09083

PCT Pub. Date: Mar. 5, 1998

(30) Foreign Application Priority Data

Aug. 26, 1996 (AU) ..... P01888

(51) Int. Cl.[7] ..... F04F 1/06; F04B 19/24

(52) U.S. Cl. ..... 417/118; 417/137; 417/144; 417/147; 417/53

(58) Field of Search ..... 417/118, 137, 417/144, 145, 147, 109, 53

(56) References Cited

U.S. PATENT DOCUMENTS 1,537,264 * 5/1925 Rogers ..... 417/109
3,422,768 * 1/1969 Pepp ..... 103/234
3,873,238 * 3/1975 Elfarr ..... 417/54
3,991,825 * 11/1976 Morgan ..... 166/86
4,527,633 * 7/1985 McLaughlin et al. ..... 166/370
4,625,801 * 12/1986 McLaughlin et al. ..... 166/267

* cited by examiner

*Primary Examiner*—Timothy S. Thorpe
*Assistant Examiner*—Timothy P. Solak
(74) *Attorney, Agent, or Firm*—Marger Johnson & McCollom, PC

(57) ABSTRACT

A pump having a pump chamber arranged to receive liquid to be pumped and air, a delivery pipe for delivery of the liquid by the air to a location remote from said pump chamber, an air pipe for flow of air therein. The delivery pipe and pump chamber are in fluid communication, as are the air pipe and said pump chamber. A first air flow control to control air flow via said air pipe during first and second stages of a pumping cycle of the pump. A timer controls the operation of said first air flow control to thereby set the durations of said first and second stages of said pumping cycle. A first valve allows liquid to enter said pump chamber. Wherein in said first stage of the pumping cycle of the pump, the first air flow control allows air to be directed via said air pipe to said pump chamber for a time period set by said timer to cause liquid to be pushed from said pump chamber into said delivery pipe with the air for delivery via said delivery pipe to said location. In the second stage of the pumping cycle said first air flow control allows air to vent from said pump chamber via said air pipe for a time period set by said timer. The first valve allows liquid to enter said pump chamber whilst liquid and air are able to continue to travel along said delivery pipe toward said location.

12 Claims, 2 Drawing Sheets

APPARATUS FOR AN AIR LIFT AND TRANSFER PUMP

FIELD OF THE INVENTION

The present invention relates to a pump. The pump uses compressed air to pump water from a bore, well or similar water source. The pump of the present invention is particularly suited to pumping water. However, the pump is not limited in its use to pumping water and may be used for pumping other liquids.

SUMMARY OF THE INVENTION

In accordance with one aspect of the present invention there is provided a pump comprising:

pump chamber means, delivery pipe means, said delivery pipe means and said pump chamber means in fluid communication, said air pipe means and said pump chamber means in fluid communication, first air flow control means to control air flow via said air pipe means, and first valve means to allow, in use, liquid to enter said pump chamber means, wherein in a first stage of a pumping cycle of the pump, said first air flow control means allows air to be directed via said air pipe means to said pump chamber means to cause liquid to be pushed into and up said delivery pipe means and, in a second stage of said pumping cycle, said first air flow control means allows air to vent from said pump chamber means via said air pipe means and said first valve means allows liquid to enter said pump chamber means.

Preferably, second valve means is provided to allow water to enter the delivery pipe means. From the pump chamber means during the first stage of the pumping cycle and prevent water escaping from the delivery pipe means into the pump chamber means during the second stage of the pumping cycle.

Preferably, air supply pipe means is provided to supply the air that is directed by said first air flow control means via said air pipe means to said pump chamber means in said first stage of the pumping cycle of the pump.

Preferably, second air flow control means is provided to allow air that is supplied by said air supply pipe means to be directed to said delivery pipe means in said second stage of the pumping cycle of the pump.

Preferably, branch pipe means is provided for air flow from said air supply pipe means to said delivery pipe means.

Preferably, third valve means is provided in said branch pipe means to allow air flow in the direction from said air supply pipe means to said delivery pipe means and prevents flow of liquid in the reverse direction.

Preferably, said third valve means is located downstream of said second air flow control means.

Preferably, said branch pipe means is connected to said delivery pipe means at a location remote from said pump chamber means.

Preferably, said branch pipe means is connected to said delivery pipe means at a location above ground level.

Preferably, timer means is provided to set the durations of the first and second stages of the pumping cycle.

In accordance with another aspect of the present invention there is provided a method of pumping liquid using a pump comprising:

in a first stage of a pumping cycle, directing air from an air supply to a pump chamber means of said pump to cause liquid to be pushed into and up a delivery pipe means of the pump, and in a second stage of said pumping cycle, allowing air to vent from said pump chamber means and liquid to enter said pump chamber means via first valve means of said pump.

Preferably, the method further comprises preventing liquid in the delivery pipe means from escaping from the delivery pipe means into the pump chamber means during the second stage of the pumping cycle.

Preferably, the method further comprises directing said air from said air supply to said delivery pipe means in said second stage of the pumping cycle of the pump.

Preferably, the method further comprises allowing flow of said air from said air supply to said delivery pipe means and preventing flow of liquid in the reverse direction in said second stage of the pumping cycle.

Preferably, the method further comprises controlling the durations of the first and second stages of the pumping cycle.

BRIEF DESCRIPTION OF THE DRAWINGS

The present invention will raw be described, by way of example, with reference to the accompanying drawings, in which.

DESCRIPTION OF THE INVENTION

Figure 1:
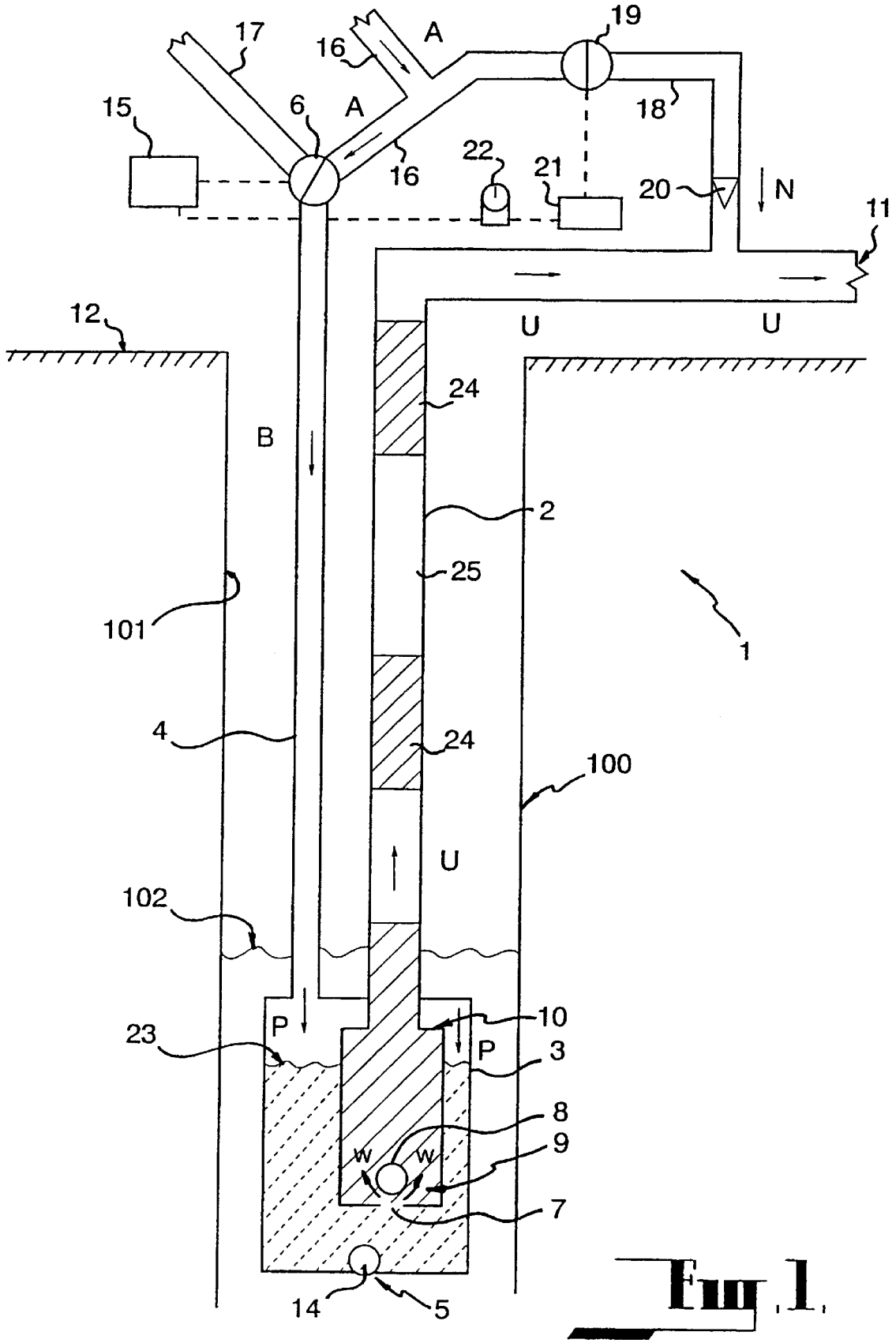
FIG. 1 is a first sectional view of an embodiment of a pump in accordance with an aspect of the present invention in a first stage of a pumping cycle.
Figure 2:
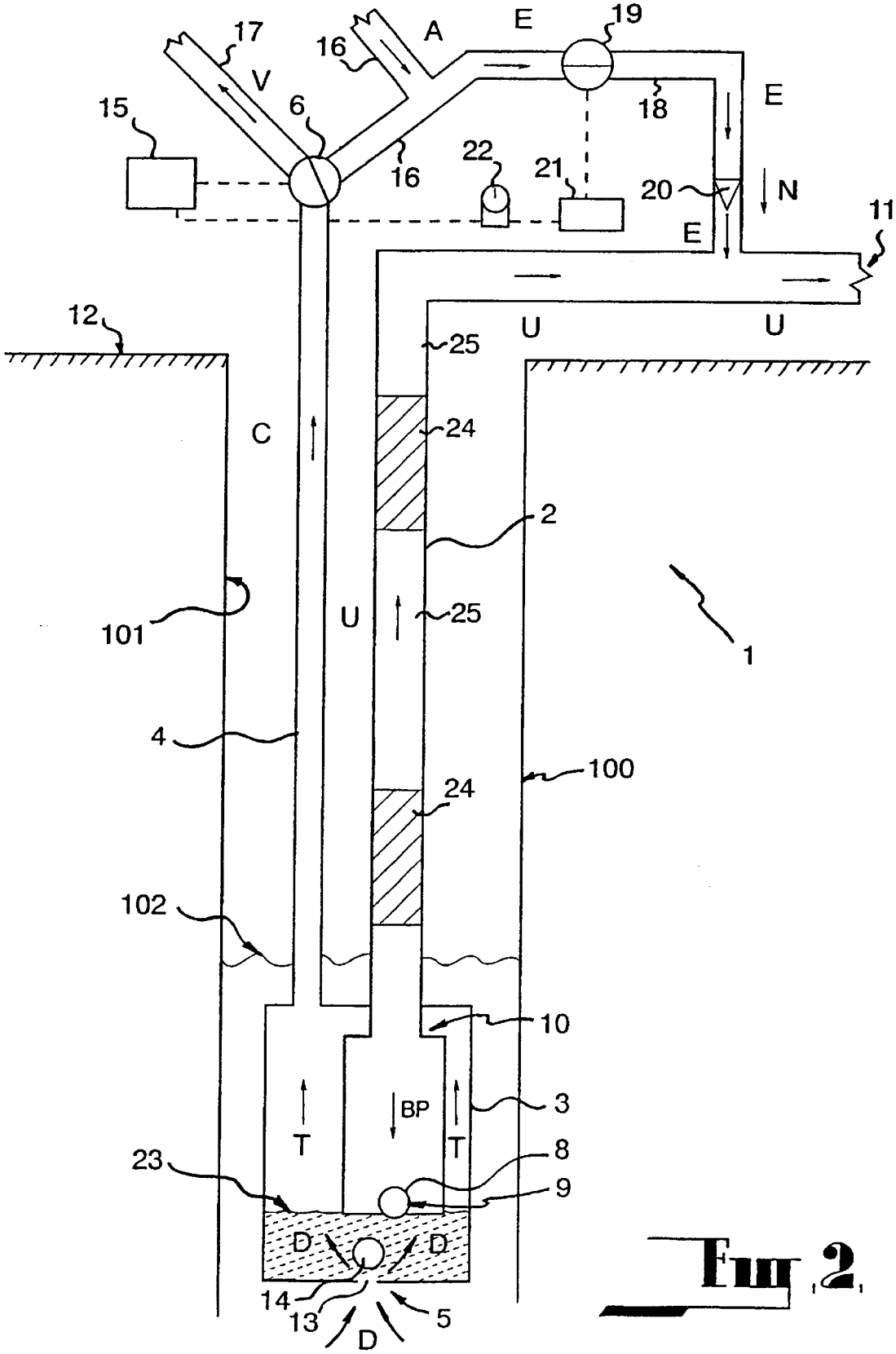
FIG. 2 is a second sectional view of the pump shown in FIG. 1 in a second stage of the pumping cycle.

In FIGS. 1 and 2, there is shown a, pump 1 for pumping water using compressed air from an air supply. The pump 1 may be located in a water source, such as a bore 100 having a casing 101.

The pump 1 comprises a delivery pipe 2, a pump chamber 3, and an air pipe 4. The delivery pipe 2 and the pump chamber 3 are in fluid communication. The air pipe 4 and the pump chamber 3 are also in fluid communication. A first valve 5 allows water to enter the pump chamber 3 from the bore 100. A first air flow control mechanism 6 controls air flow via the air pipe 4. As will be described in further detail herein, in a first stage of a pumping cycle of the pump 1, the first air flow control mechanism 6 allows air to be directed via the air pipe 4 to the pump chamber 3 to cause water to be pushed into and up the delivery pipe 2 and, in a second stage of the pumping cycle, the first air flow control mechanism 6 allows air to vent from the pump chamber 3 via the air pipe 4 and of the first valve 5 allows water-to enter the pump chamber 3.

The delivery pipe 2 and the pump chamber 3 are in fluid communication via an opening 7 located at the bottom of the delivery pipe 2. A second valve 9 controls entry of water and air from the pump chamber 3 into the delivery pipe 2. The second valve 9 comprises the opening 7 and a ball 8 which can seat on the opening 7. The lower region 10 of the delivery pipe 2 may have a larger diameter than the remainder of the delivery pipe 2. This can be seen in FIGS. 1 and 2. This provides the lower region 10 of the delivery pipe 2 with an increased volume for entry of water and air therein via the opening 7 from the pump chamber 3. The second valve 9 is provided at the lower region 10 in the delivery pipe 2. The opening 7 of the delivery pipe 2 is located inside the pump chamber 3.

The delivery pipe 2 extends from the pump chamber 3 to an outlet 11 provided at ground level 12.

The air pipe 4 extends from he fist air flow control mechanism 6 to the pump chamber 3 into which it opens such that the air pipe 4 and the pump chamber 3 are in fluid communication.

The first valve 5 comprises an opening 13 and a ball 14 which can seat on the opening 13. The ball 14 is provided in the pump chamber 3. Water is able to enter the pump chamber 3 from the bore 100 via the opening 13 when the ball 14 lifts off the opening 13, as can be seen in FIG. 2.

A solenoid 15 may be provided to operate the first air flow control mechanism 6.

An air supply pipe 16 is provided to supply compressed air which travels to the pump chamber 3 via the first air flow control mechanism 6 and the air pipe 4. The compressed air is supplied by a compressor (not shown).

A vent pipe 17 is provided to enable air to be vented from the pump chamber 3 via the pipe 4 and through the vent pipe 17.

The first air flow control mechanism 6 may be operated in two modes.

In the first mode, shown in FIG. 1, air is able to flow from the air supply pipe 16 (as shown by arrows A) through the air flow control mechanism 6 and into the air pipe 4 (as shown by arrow B). This is the mode of operation of the first air flow control mechanism 6 in the first stage of the pumping cycle.

In the second mode, shown in FIG. 2, the air flow control mechanism 6 prevents air flow into the air pipe 4 from the air supply pipe 16 and instead enables air to be vented from the pump chamber 3 (as shown by arrows T in FIG. 2) up through the air pipe 4 (as shown by arrow C in FIG. 2) through the air flow mechanism 6 and out through the vent pipe 17 (as shown by the arrow V in FIG. 2). This is the mode of operation of the first air flow control mechanism 6 in the second stage of the pumping cycle.

The air flow control mechanism 6 may be provided as a 3-way or 5-way valve.

A branch pipe 18 extends from the air supply pipe 16 to the delivery pipe 2. A second air control mechanism 19 controls flow of air via the branch pipe 18. The second air flow control mechanism 19 allows air that is supplied by said air supply pipe 16 to be directed to the delivery pipe 2 in the second stage of the pumping cycle of the pump 1.

A no return valve 20 is provided in the branch pipe 18 to allow air to flow therethrough in the direction from the air supply pipe 16 to the delivery pipe 2 (as shown by arrow N) and prevent flow of liquid in the reverse direction.

The no return valve 20 is located downstream of the second air flow control mechanism 19.

The branch pipe 18 is connected to the delivery pipe 2 at a location remote from the pump chamber 3, such at a location above ground level 12.

A solenoid 21 may be provided to operate the second air flow control mechanism 19.

The operations of the solenoids 15 and 21 are synchronised,

A timer 22 is provided to control the operation of the solenoids 15 and 21. Alternatively, the solenoids 15 and 21 my be prided with individual timers.

The second airflow conk mechanism 19 may be operated in two modes.

In the first mode shown in FIG. 1, air is prevented flowing through the branch pipe 18 to the delivery pipe 2. This is the mode the operation of the second air flow control mechanism in the first sage of the pumping cycle.

In the second mode, as shown in FIG. 2, the air flow control mechanism 19 allows air flow from the supply pipe 16 into the branch pipe 18 (as shown by arrows E in FIG. 2). The air then flows into the delivery pipe 2 toward the outlet 11. This is the mode of operation of the second air flow control mechanism 19 in the second stage of the pumping cycle.

In use, the pump 1 is suspended from ground level 12 to below the water line 102 in a bore 100.

When the pump 1 is fist lowered into the water in the bore 100, the water in the bore 100 forces the balls 14 and 8 off their respective seats at the openings 13 and 7. This allows water to enter the pump chamber 3 and the lower region 10 of the delivery pipe 2 via the openings 13 and 7.

To commence the pumping cycle of the pump 1, compressed air is supplied by a compressor via the supply pipe 16 through the air control mechanism 6 and via the air pipe 4 into the pump chamber 3.

During this first stage of the pumping cycle, the air flow control mechanism 6 allows air to flow from the supply line 16 into the air pipe 4, with the solenoid 15 retaining the air flow control mechanism 6 in this condition for the time as set by the timer.

Further during this first stage of the pumping cycle, the second air flow control mechanism 19 prevents air flowing t h the branch line 18 from the supply line 16.

In this first stage of the pumping cycle, the compressed air being supplied to the pump chamber 3 exerts pressure (shown by arrows P in FIG. 1) on the surface 23 of the water in the pump chamber 3. This pressure causes the ball 14 to seat on the opening 13 to prevent further entry of water from the bore 100 into the pump chamber 3. The air pressure acting on the surface 23 of the water in the pump chamber 3 also acts to push water from the pump chamber 3 into the delivery pipe 2 (shown by arrows W in FIG. 1) by causing the ball 8 to unseat from the opening 7. In this way, air and water enter the delivery pipe 2. Water is pushed up the delivery pipe 2 in parcels, or packets, 24 by parcels, or packed 25 of compressed air. The water parcels 24 travel up the delivery pipe 2 (with the air parcels 25), as shown by Cow U, such that they exit the delivery pipe 2 via the opening 11 where the water 24 can be collected (not shown).

Once the solenoid 15 has held the first air flow control mechanism 6 and the solenoid 21 has held the second air flow control mechanism 19 in their respective conditions in which the pump I operates in the first stage (as shown in FIG. 1) for the time as pre-set by the timer 2Z, the solenoid 15 causes the first air flow control mechanism 6 to move into the mode for the second stage of the pumping cycle (as shown in FIG. 2). Similarly, the salenoid 21 causes the second air flow control mechanism 19 to move into the mode for the second stage of the pumping cycle. The solenoid 15 will maintain the first air flow control mechanism 6 in this condition for a preset time as set by the timer 22. Similarly, the solenoid will maintain the second air flow control mechanism 19 in this condition for the preset time as set by the timer 22.

In the second stage of the pumping cycle (shown in FIG. 2) the first air flow control mechanism 6 prevents compressed air from being directed by the supply pipe 16 into the air pipe 4. Instead, the first air flow control mechanism 6 enables air to vent from the pump chamber 3 via the air pipe 4 (as shown at arrow C) and through the first air control mechanism 6 and out through the vent pipe 17 as shown at arrow V.

Further, during this second stage of the pumping cycle, the second air flow control mechanism 19 allows air to flow from the supply pipe 16 into the branch pipe 18. The air often flows from the branch pipe 16 into the delivery pipe 2 and exits via the outlet 11.

Thus, during the first stage of the pumping cycle, the pressure in the pump chamber 3 and in the delivery pipe 2 increases due to the compressed air being supplied by the compressor via the supply pipe 16 and air pipe 4. When the pumping cycle enters the second stage, the air in the pump chamber 3 (still being at a higher pressure) will vent via the air pipe 4 and vent pipe 17 as just described. As the pressure in the pump chamber 3 decreases during this second stage, the point is reached where the pressure in the pump chamber 3 drops to a level below the pressure of the water in the bore 100 outside the pump 1. At this point, the pressure of the wider in the bore 100 will be sufficient to lift the ball 14 off the seat of the opening 13 so that water from the bore 100 can enter via the opening 13. This is shown by arrows D In FIG. 2. Water will enter the pump chamber 3 in this way whilst the solenoid 15 holds the air flow mechanism 6 in the condition which allows venting of air from the pump chamber 3.

During the second stage of the pumping cycle, the back pressure exerted by the compressed air hat is in the delivery pipe 2 acts on the ball 8 (as shown by arrow BP In FIG. 2) to seat the ball 8 against the opening 7. This prevents the air and water in the delivery pipe 2 from returning to the pump chamber 3. In addition, due to the pressure existing in the delivery pipe 2 the air parcels 25 will expand (as shown in FIG. 2) and thereby continue to push the water parcels 24 slowly up the delivery pipe 2. Furthermore, the air directed to the delivery pipe 2 by the second air flow control mechanism 19 via tie branch pipe 18 assists the carriage of water parcels 25 up the delivery pipe 2 to the outlet I1.

When the time set by the timer 22 has elapsed for the second stage of the pumping cycle, the solenoid 15 operates the first air flow control mechanism 6 to switch from the second stage (shown in FIG. 2) to the first stage of the pumping cycle (shown in FIG. 1). Similarly, the solenoid 21 operates the second air flow control mechanism 19 to from the second stage back to the first stage of the pumping cycle The pump 1 then operates in the first stage of the pumping cycle previously.

The two stage cycle described above is continuously repeated (provided compressed air is supplied to the pump 1) such that water is pushed up the delivery pipe 2 to the outlet 11 for collection.

As an alternative to the embodiment herein described, the branch line 18 and second flow control mechanism 19 may be omitted. In such an embodiment, air from the supply line 16 is simply not used in the second stage of the pumping cycle.

The durations of the first and second stages of the pumping cycle are dependent upon factors such as the depth of the pump 1 in the bore 100 and the size of the pump chamber 3. Thus, the deeper the pump 1 is positioned in a bore, the longer the first stage of the pumping cycle will be. Thus, typically, the first stage of the pumping cycle may be 30 seconds duration whilst the second stage may be 6 seconds duration. If the pump 1 is located at a lesser depth, then the first stage of the cycle may be of lesser duration.

Similarly, if the pump chamber 3 is of a relatively large size, then the second stage of the cycle will need to be of a longer duration than it otherwise would be. Thus, typically for a relatively large chamber (about 20 liters), the fist stage of the cycle may be of 20 seconds duration and the second stage may be 10 seconds duration.

Typically, the pump chamber 3 may have a volume of approximately 10 to 20 liters. The volume of the pump chamber 3 will depend upon the pumping situation. If the pump 1 is to be used with a plentiful water supply, then a relatively large pump chamber 3 may be used. Conversely, if the water supply is not as plentiful, a smaller pump chamber 3 may be used.

The pump 1 of the present invention may operate in relatively shallow water depths. Thus, the pump 1 may operate in bores having a water depth as low as approximately 1 meter. However, the pump 1 may be used in bores down to a depth of approximately 125 meters.

Typically, the pump 1 operates in a bore 100 having a water depth of approximately 1 meter. Typically, the pump chamber 3 may have a volume of 10 to 20 liters, depending upon the quantity of water in the water source.

Whilst the pump of the present invention has been herein before described with particular reference to its use in pumping water from a bore, the pump of the present invention is also suitable for pumping other liquids. Accordingly, it is to be understood that reference to the pump of the present invention being used to pump water in this specification does not restrict the invention to use solely for pumping water.

Modifications and variations such as would be apparent to a skilled addressee are deemed to be within the scope of the present invention.

What is claimed is:

1. A pump comprising:

a pump chamber arranged to receive liquid to be pumped and air;

a delivery pipe for delivery of the liquid by the air to a location remote from said pump chamber;

an air pipe for flow of air therein;

said delivery pipe and said pump chamber in fluid communication;

said air pipe and said pump chamber in fluid communication;

a first air flow control to control air flow via said air pipe during first and second stages of a pumping cycle of the pump;

a timer to control the operation of said first air flow control to thereby set the durations of said first and second stages of said pumping cycle; and a first valve to allow, in use, liquid to enter said pump chamber;

wherein an air supply pipe is provide to supply the air that is directed by said first air flow control via said air pipe to said pump chamber in said first stage of said pumping cycle of the pump;

wherein a branch pipe is provided for air flow from said air supply pipe to said delivery pipe in said second stage of said pumping cycle to assist carriage of liquid along said delivery pipe in said second stage of said pumping cycle;

wherein in said first stage of said pumping cycle of the pump, said first air flow control allows air to be directed via said air pipe to said pump chamber for a time period set by said timer to cause liquid to be pushed from said pump chamber into said delivery pipe with the air for delivery via said delivery pipe to said location, and in said second stage of said pumping cycle said first air flow control allows air to vent from said pump chamber via said air pipe for a time period set by said timer and said first valve allows liquid to enter said pump chamber whilst liquid and air are able to continue to travel along said delivery pipe toward said location.

2. A pump according to claim 1, wherein a second valve is provided to allow, in use, liquid to enter said delivery pipe from said pump chamber during said first stage of said pumping cycle and prevent liquid escaping from said delivery pipe into said pump chamber during said second stage of said pumping cycle, said second valve arranged such that the pressure of the air in said delivery pipe maintains said second valve closed to prevent liquid escaping from said delivery pipe in said second stage of said pumping cycle.

3. A pump according to claim 1, wherein second air flow control is provided and allows air that is supplied by said air supply pipe to be directed via said branch pipe to said delivery pipe in said second stage of said pumping cycle of the pump.

4. A pump according to claim 1, wherein third valve is provided in said branch pipe to allow air flow in the direction from said air supply pipe to said delivery pipe and prevent flow of liquid in the reverse direction in said second stage of said pumping cycle.

5. A pump according to claim 4, wherein said third valve is located downstream of said second air flow control.

6. A pump according to claim 1, wherein said branch pipe is connected to said delivery pipe at a location remote from said pump chamber.

7. A pump according to claim 1, wherein in said first stage of said pumping cycle, said air directed via said air pipe to said pump chamber closes said first valve to prevent liquid entering said pump chamber.

8. A method of pumping liquid using a pump comprising:

in a first stage of a pumping cycle, directing air from an air supply to a pump chamber of said pump to cause liquid to be pushed into a delivery pipe of said pump with the air, and delivering the liquid by the air via said delivery pipe to a location remote from said pump chamber;

in a second stage of said pumping cycle, allowing air to vent from said pump chamber and allowing liquid to enter said pump chamber whilst liquid and air are able to continue to travel along said delivery pipe toward said location; and controlling the duration during which air is directed from said air supply to said pump chamber and the duration during which air is allowed to vent from said pump chamber during said first and second stages, respectively, of said pumping cycle.

9. A method according to claim 8, wherein it further comprises preventing liquid in said delivery pipe from escaping from said delivery pipe into said pump chamber in said second stage of said pumping cycle due to the pressure of the air in said delivery pipe acting to close a valve of the pump.

10. A method according to claim 8, wherein it further comprises preventing liquid entering said pump chamber during said first stage of said pumping cycle.

11. A method according to claim 8, wherein it further comprises directing air from said air supply to said delivery pipe in said second stage of said pumping cycle of the pump to assist carriage of liquid along said delivery pipe in said second stage of said pumping cycle.

12. A method according to claim 11, wherein it further comprises allowing flow of said air from said air supply to said delivery pipe and preventing flow of liquid in the reverse direction in said second stage of said pumping cycle.

* * * * *

UNITED STATES PATENT AND TRADEMARK OFFICE

CERTIFICATE OF CORRECTION

PATENT NO. : 6,234,761 B1
DATED : May 22, 2001
INVENTOR(S) : Kocsis et al.

It is certified that error appears in the above-identified patent and that said Letters Patent is hereby corrected as shown below:

Column 1,
Line 37, “pipe means. From the” should read -- pipe means from the --.

Column 2,
Line 24, “will raw be described” should read -- will now be described --.
Line 52, “allows water – to enter” should read -- allows water to enter --.

Column 3,
Line 63, “my be prided with” should read -- may be provided with --.
Line 64, “airflow conk” should read -- airflow control --.

Column 4,
Line 12, “pump 1 is fist” should read -- pump 1 is first --.
Line 28, “t h the” should read -- through the --.
Line 41, “packed 25” should read -- packets 25 --.
Line 43, “Cow U” should read -- Arrow U --.
Line 48, “pump I” should read -- pump 1 --.
Line 49, “timer 2Z” should read -- timer 22 --.
Line 52, “the salenoid” should read -- the solenoid --.

Column 5,
Line 4, “often flows” should read -- then flows --.
Line 17, “wider in the bore” should read -- water in the bore --.
Line 19, “arrows D In” should read -- arrows D in --.
Line 25, “air hat” should read -- air that --.
Line 26, “BP In” should read -- BP in --.
Line 41, “19 to from” should read -- 19 to switch from --.
Line 45, “cycle previously.” should read -- cycle previously described. --

UNITED STATES PATENT AND TRADEMARK OFFICE

CERTIFICATE OF CORRECTION

PATENT NO. : 6,234,761 B1
DATED : May 22, 2001
INVENTOR(S) : Kocsis et al.

It is certified that error appears in the above-identified patent and that said Letters Patent is hereby corrected as shown below:

Column 6,
Line 67, "fist stage" should read -- first stage --.

Signed and Sealed this

Eleventh Day of February, 2003

JAMES E. ROGAN
*Director of the United States Patent and Trademark Office*